US008774312B2

(12) United States Patent
Schandl et al.

(10) Patent No.: US 8,774,312 B2
(45) Date of Patent: Jul. 8, 2014

(54) METHOD AND MEANS FOR THE SCALABLE IMPROVEMENT OF THE QUALITY OF A SIGNAL ENCODING METHOD

(75) Inventors: Stefan Schandl, Vienna (AT); Panji Setiawan, Munich (DE)

(73) Assignee: Siemens Enterprise Communications GmbH & Co. KG, Munich (DE)

( * ) Notice: Subject to any disclaimer, the term of this patent is extended or adjusted under 35 U.S.C. 154(b) by 456 days.

(21) Appl. No.: 13/133,978

(22) PCT Filed: Dec. 10, 2009

(86) PCT No.: PCT/EP2009/008853
§ 371 (c)(1),
(2), (4) Date: Oct. 5, 2011

(87) PCT Pub. No.: WO2010/069513
PCT Pub. Date: Jun. 24, 2010

(65) Prior Publication Data

US 2012/0014474 A1 Jan. 19, 2012

(30) Foreign Application Priority Data

Dec. 19, 2008 (AT) ..... A 1982/2008

(51) Int. Cl.
*H04K 1/02* (2006.01)

(52) U.S. Cl.
USPC ..... 375/296; 375/146; 375/219; 375/253

(58) Field of Classification Search
USPC ..... 375/296
See application file for complete search history.

(56) References Cited

U.S. PATENT DOCUMENTS

2004/0054529 A1 3/2004 Sung et al.

FOREIGN PATENT DOCUMENTS

DE 3115859 A1 3/1982
DE 69124034 T2 7/1997

OTHER PUBLICATIONS

Written Opinion of the International Searching Authority for PCT/EP2009/008853 dated Mar. 26, 2010 (Form PCT/ISA/237) (German Translation).
Written Opinion of the International Searching Authority for PCT/EP2009/008853 dated Mar. 26, 2010 (Form PCT/ISA/237) (English Translation).

(Continued)

*Primary Examiner* — Lihong Yu
(74) *Attorney, Agent, or Firm* — Buchanan Ingersoll & Rooney PC

(57) ABSTRACT

The invention relates to a method for the scalable improvement of the quality of an encoding method according to IT-U Recommendation G.722, including the following steps: —a digital error signal (E) derived from an input signal to be encoded and a prognosis signal is compared in sections to a number of M*LN different reference signals in an iterative process having a number of repeated steps depending on the scope of the expansion, and the reference signal having a minimum error signal of a prescribed error criteria is derived therefrom, —the reference signals are each made up of equidistant Dirac impulses δ(n) according to (I), wherein off=[0 . . . M−1], indicates the distance of the first impulse from a zero time point, α∈{α, α, . . . , α} indicates the amplitude value, M the distance between the individual pulses, N the number of pulses, and L the number of different levels, —the information about the reference signal having the minimum error signal is transmitted.

$$c(n) = \sum_{p=0}^{N-1} \alpha_p \cdot \delta(n - \text{off} - M \cdot p) \quad \text{(I)}$$

10 Claims, 3 Drawing Sheets

(56) References Cited

OTHER PUBLICATIONS

International Preliminary Report on Patentability for PCT/EP2009/008853 dated Jun. 21, 2011 (Form PCT/IB/373, PCT/ISA/237) (German Translation).

International Preliminary Report on Patentability for PCT/EP2009/008853 dated Jun. 21, 2011 (Form PCT/IB/373, PCT/ISA/237) (English Translation).

International Search Report of PCT/EP2009/008853 dated Mar. 26, 2010 (English).

International Search Report of PCT/EP2009/008853 dated Mar. 26, 2010 (German).

"7 kHz Audio-Coding within 64 kbits/s; G.722 (11/88)" ITU—Standard in Force (I), International Telecommunication Union, Geneva, CH, No. G.722 (Nov. 25, 1988).

"Reduced Rate Ultra Low Delay Audio Coder Using Multistage Vector Quatization" T. V. Sreenivas, et al., Signals, System and Computers 2007, 2007 Association, Conference on IEEE, Piscataway, NJ, US.

METHOD AND MEANS FOR THE SCALABLE IMPROVEMENT OF THE QUALITY OF A SIGNAL ENCODING METHOD

CROSS-REFERENCE TO RELATED APPLICATIONS

This application is the United States National Phase under 35 U.S.C. §371 of PCT International Patent Application No. PCT/EP2009/008853, filed on Dec. 10, 2009, and claiming priority to Austrian application no. A1982/2008, filed on Dec. 19, 2008.

BACKGROUND OF THE INVENTION

Field of the Invention

Embodiments of the invention relate to a method and means for the scalable improvement of the quality of a signal encoding method.

To reduce the data rates necessary in digital communications systems, the audio signals being transmitted are compressed by means of encoding methods and then decompressed after the transmission.

An encoding method of this kind, which is used for the transmission of a voice signal in a frequency range from 300 to 3400 Hz at a data rate of 8 kbit/s, is known, for example, from ITU-T-Recommendation G.729.

For higher quality transmission, an expanded frequency range from 50 Hz up to 7000 Hz is known. For example, ITU-T-Recommendation G.722.EV describes a broadband method known as the Voice-Codec for this purpose.

This method uses Subband-Adaptive Differential Pulse Code Modulation (SB-ADPCM) for encoding audio signals.

BRIEF SUMMARY OF THE INVENTION

To further increase the quality of the transmitted audio signal, a scalable encoding method is needed.

On the one hand, this scalability will give the receiver downstream compatibility with conventional decoding methods, and on the other hand, it offers the possibility, in the event of limited data transmission capacities in the transmission channel, of easily adapting the data rate and the size of transmitted data frames on both the sending and receiving sides.

Embodiments presented herein provide methods for scalable improvement of the quality of an encoding method according to the Subband-Adaptive Differential Pulse Code principle.

Embodiments may further provide a method for scalable improvement of the quality of an encoding method according to IT-U-Recommendation G.722 with the following method steps: a digital error signal, derived from an input signal to be encoded and a prognosis signal, is compared in sections to a number of $M*L^N$ different reference signals in an iterative process having a number of repeated steps depending on the scope of the expansion, and the reference signal having a minimum error signal with respect to a prescribed error criterion is derived there from the reference signals c(n) are each made up of equidistant Dirac impulses δ(n) according to $$c(n) = \sum_{p=0}^{N-1} \alpha_p \cdot \delta(n - \text{off} - M \cdot p)$$

wherein off=[0 . . . M−1] indicates the distance of the first pulse from the beginning of the comparison segment, $\alpha_p \in \{\alpha_0, \alpha_1, \ldots, \alpha_{L-1}\}$ indicates the amplitude value, M the distance between two individual pulses, N the number of pulses, and L the number of different levels α.

The information about the reference signal with the minimum error signal is transmitted.

Here it is preferable for an expanded error signal $e_{H1}(n)$ to be determined as the error criterion according to $e_{H1}(n)=e_H-c(n)$ and for an error value to be determined over the time period of the comparison segment as per $$E_n = \sum_{n=0}^{Ma} e_{H1}(n)^2$$

and then be used to determine the minimum error signal.

It is also preferable to have an arrangement for implementing the method according to the invention, in which—in addition to a conventional encoder (ADPCM) operating according to the Subband Adaptive Differential Pulse Code principle according to IT-U Recommendation G.722—means are provided for the creation of reference signals which have, for each step of the expansion, a signal generator EHDS1, . . . EHDSS to generate the reference signals c(n) and a control unit CB 1, . . . CB S.

DETAILED DESCRIPTION OF THE INVENTION

Embodiments will now be discussed with reference to the figures.

Figure 1:
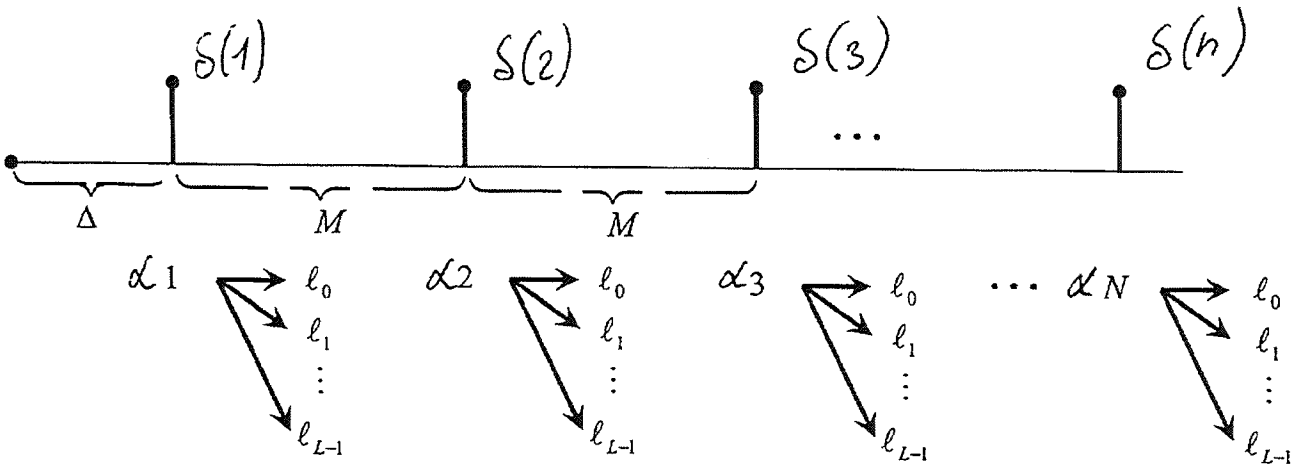
FIG. 1: The generation of a reference signal according to the invention

The reference signal according to FIG. 1 comprises a number of N Dirac pulses δ(n). Each of the intervals between the individual pulses amounts to M sampling periods; the interval of the first pulse δ(1) from the beginning of the comparison segment amounts to off=[0 . . . M−1] sampling periods. The Dirac pulses can have a preset number of amplitude values L.

The mathematical definition of a reference signal is as follows:

$$c(n) = \sum_{p=0}^{N-1} \alpha_p \cdot \delta(n - \text{off} - M \cdot p)$$

By varying the parameters of the amplitude value α with L different values and with the offset off=[0 . . . M−1], a group with the quantity $M \cdot L^N$ of different reference signals is produced.

Figure 2:
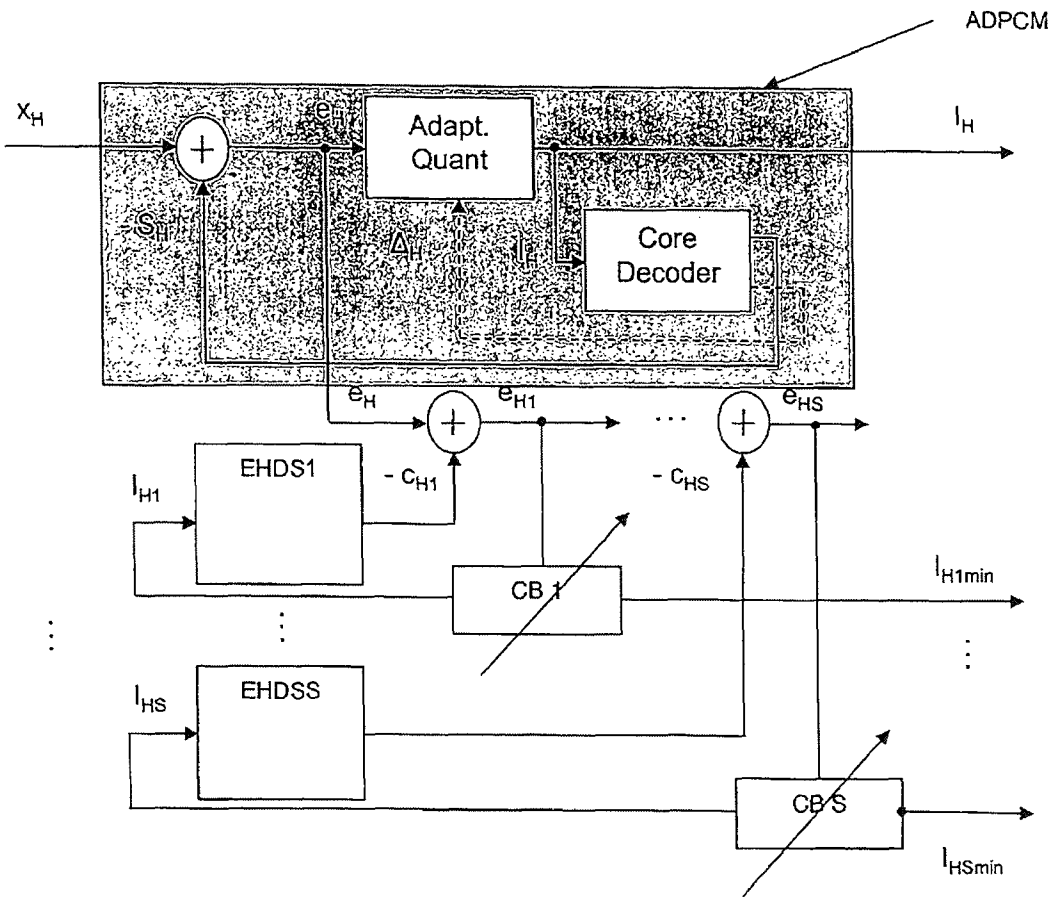
FIG. 2: The structure of a Codec according to the invention.
Figure 3:
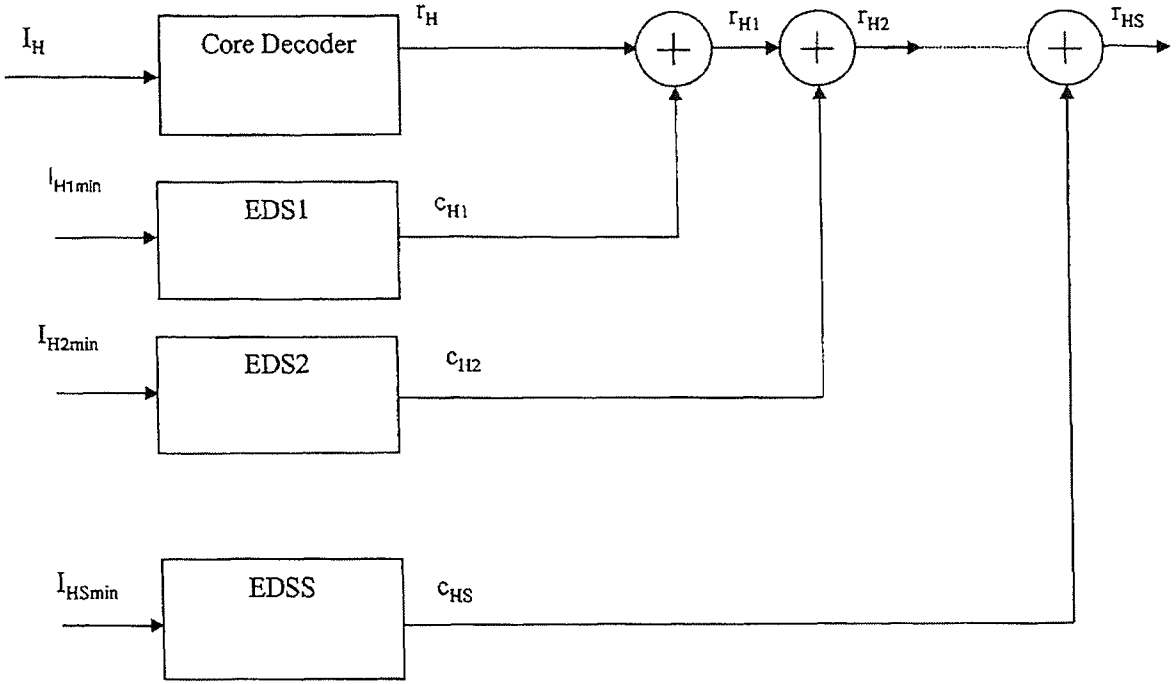
FIG. 3: The structure of a decoder according to the invention.

The comparison of reference signals c(n) obtained in this manner according to the invention is explained in greater detail based on FIGS. 2 and 3. FIG. 2 shows the structural configuration of an encoder according to the invention, which—in addition to a conventional encoder ADPCM operating according to the Subband Adaptive Differential Pulse Code principle per IT-U Recommendation G.722—includes the means to generate reference signals which, for each step of the expansion, have a signal generator EHDS1, . . . EHDSS to generate the reference signals c(n) and a control unit CB 1, . . . CB S.

According to the invention, the reference signals c(n) are compared, over a preset time segment known as a frame, to a digital error signal $e_H$ which was determined in a conventional encoding process according to IT-U Recommendation G.722 from an input signal for encoding and a prognosis signal.

Thus, according to $e_{H1}(n)=e_H-c(n)$, an expanded error signal $e_{H1}(n)$ is obtained for which an error value is determined over the time period of the comparison segment according to $$E_n = \sum_{n=0}^{Ma} e_{H1}(n)^2.$$

By means of control unit CB 1, . . . CB S, the reference signal c(n) with the smallest error value $E_n$ is now determined, and the information about this signal is transmitted as supplemental information $I_{H1min}$, . . . $I_{HSmin}$ and is used in the receiver to decode the payload signal.

In practice, the following parameters have proven valuable for generating the reference signal c(n).

The starting point is a sampling rate of 8 KHz and thus a sampling interval duration of 125 μsec. The duration of one comparison segment amounts to 5 msec, and the possible quantity of amplitude values L for the Dirac pulses amounts to 2. The number of Dirac pulses in one comparison segment amounts to N=5. The interval between every 2 Dirac pulses amounts to M=8 sampling intervals.

The process described above for comparing the reference signals c(n) with the digital error signal $e_H$ is now repeated iteratively as a function of the selected scaling, which is illustrated in FIG. 2 for the Sth repetition process by means of a function block with signal generator EHDSS, control unit CB S and additional information signal $I_{HSmin}$.

For the first repetition step this means that the reference signals c(n) are compared with the expanded first error signal $e_{H1}(n)$, and from this an expanded second error signal $E_{H2}(n)$ is produced. This process is typically repeated four times.

FIG. 3 shows the structure of a decoder according to the invention in which the audio signal is obtained from the received signal $I_H$, $I_{H1}$, $I_{H2}$ . . . $I_{HS}$. The received signal comprises—in addition to the output signal $I_H$ from the conventional encoder ADPCM—the supplemental information $I_{H1min}$, . . . $I_{HSmin}$ obtained with the invention as a function of the number of expansion steps selected in the transmitter.

An important advantage herein is that not all information contained in the received signal actually also has to be evaluated. For example, it is possible that a receiver with only one conventional Core Decoder will receive a signal which also contains the supplemental information $I_{H1min}$, . . . $I_{HSmin}$, but does not use it to obtain the audio signal.

This possibility is called downstream compatibility.

However, in the case of a receiver which contains the invented expansion stages EDS1, EDS2, . . . EDSS for decoding the supplemental information $I_{H1min}$, . . . $I_{HSmin}$, the full quality of the signal is decoded, provided no limitation is imposed for other reasons.

The invention claimed is:

1. A method for scalable improvement of a quality of an encoding method according to International Telecommunication Union ("ITU") Recommendation G.722, comprising:

comparing a digital error signal ("$e_H$"), derived from an input signal to be encoded and a prognosis signal, in sections to a number of $M*L^N$ different reference signals ("c(n)") in an iterative process having a number of repeated steps depending on a scope of an expansion;

deriving from each comparison a reference signal having a minimum error signal with respect to a prescribed error criterion, wherein each of the reference signals is made up of equidistant Dirac impulses ("δ(n)") according to the formula $$c(n) = \sum_{p=0}^{N-1} \alpha_p \cdot \delta(n - \text{off} - M \cdot p)$$

and wherein off=[0, . . . M−1] indicates a distance of a first impulse from a beginning of a comparison segment, $\alpha_p \in \{\alpha_0, \alpha_1, \ldots, \alpha_{L-1}\}$ indicates an amplitude value, M is a distance between two individual pulses, N is a number of pulses, L is a number of different levels α; and transmitting information about the reference signal with the minimum error signal.

2. The method of claim 1, comprising determining an expanded error signal ("$e_{H1}(n)$") as an error criterion according to $e_{H1}(n)=e_H-c(n)$, and over a period of a comparison segment;

calculating an error amount according to $$E_n = \sum_{n=0}^{Ma} e_{H1}(n)^2; \text{ and}$$

determining a minimum error signal using the calculated error amount.

3. An arrangement for implementing the method of claim 1, comprising a conventional encoder operating according to a Subband Adaptive Differential Pulse Code principle according to ITU Recommendation G.722 and means for generating reference signals which, for each step of the expansion, have a signal generator to generate the reference signals c(n), and a control unit that determines the error reference signal having a smallest error value.

4. A decoder configured to implement the method of claim 1.

5. The method of claim 1, wherein a control unit transmits the information about the reference signal with the minimum error signal.

6. The method of claim 1, further comprising:

utilizing information about the reference signal with the minimum error signal to decode a payload signal.

7. The method of claim 1, further comprising:

utilizing information about the reference signal with the minimum error signal to decode payload data.

8. The method of claim 1, further comprising:

adapting at least one of a data rate and a size of transmitted data frames for transmissions of data that is to be transmitted.

9. The method of claim 8, wherein the data to be transmitted is audio data.

10. The method of claim 1, wherein L is 2, N is 5, and M is 8.

* * * * *